US011542077B2

(12) United States Patent
Ashton

(10) Patent No.: US 11,542,077 B2
(45) Date of Patent: Jan. 3, 2023

(54) DUAL-PURPOSE CONTAINER CLOSURE

(71) Applicant: Jason Ashton, Watsonville, CA (US)

(72) Inventor: Jason Ashton, Watsonville, CA (US)

( * ) Notice: Subject to any disclaimer, the term of this patent is extended or adjusted under 35 U.S.C. 154(b) by 0 days.

(21) Appl. No.: 17/196,625

(22) Filed: Mar. 9, 2021

(65) Prior Publication Data

US 2021/0261307 A1 Aug. 26, 2021

Related U.S. Application Data

(62) Division of application No. 16/797,665, filed on Feb. 21, 2020, now Pat. No. 10,974,881.

(51) Int. Cl.

| | |
|---|---|
| ***B65D 51/28*** | (2006.01) |
| ***B65D 47/06*** | (2006.01) |
| ***B65D 51/16*** | (2006.01) |
| ***A24F 13/12*** | (2006.01) |
| ***B65D 25/04*** | (2006.01) |
| ***A24F 15/01*** | (2020.01) |
| ***B65D 43/02*** | (2006.01) |

(52) U.S. Cl.

CPC ..... *B65D 51/28* (2013.01); *A24F 13/12* (2013.01); *A24F 15/01* (2020.01); *B65D 25/04* (2013.01); *B65D 43/0231* (2013.01); *B65D 47/065* (2013.01); *B65D 51/1633* (2013.01)

(58) Field of Classification Search

CPC .. A24F 7/00; A24F 40/42; A24F 40/60; A24F 5/00; A24F 40/10; A24F 15/01; A24F 13/12; A24F 1/14; A24F 1/30; A24F 47/008; B65D 51/28; B65D 25/04; B65D 43/0231; B65D 47/065; B65D 51/1633; B65D 25/20; B65D 51/2807; A61M 2205/59; A45F 3/16; A62B 18/086; A47G 19/22

See application file for complete search history.

(56) References Cited

U.S. PATENT DOCUMENTS

2014/0102463 A1* 4/2014 Jones ..... A61M 15/06 131/329
2017/0129665 A1* 5/2017 Rolfes ..... B65D 47/0885

* cited by examiner

*Primary Examiner* — Shawn M Braden
(74) *Attorney, Agent, or Firm* — Donald R. Boys; Central Coast Patent Agency LLC

(57) ABSTRACT

A dual-access closure for a beverage container has a body with a flexible rim adapted to snap over an upper rim of a beverage container, a sealed, elongated enclosure attached to an underside of the body, a first access element adapted to open and close a first opening passing through the body into the sealed, elongated enclosure, a vapor-producing apparatus within the sealed, elongated enclosure and coupled to the first opening, and a second access element adapted to open and close a second opening passing through the body, outside the sealed, elongated enclosure. With the body engaged to the top of the beverage container, a user is enabled to manipulate the first access interface to draw vapor from the vapor-producing apparatus, and to manipulate the second access element to ingest a beverage from the beverage container.

6 Claims, 8 Drawing Sheets

DUAL-PURPOSE CONTAINER CLOSURE

CROSS-REFERENCE TO RELATED APPLICATIONS

The present invention is a divisional application of co-pending application Ser. No. 16/797,665 filed Feb. 21, 2020, titled "Dual-Purpose Container Closure". All disclosure of the parent application is incorporated at least by reference.

BACKGROUND OF THE INVENTION

1. Field of the Invention

The present invention is in the technical area of apparatus and methods for smoking tobacco and other materials, and pertains more particularly to a container closure that enables a user to access a vapor pen enclosed in the container, or to ingest liquid from the container as well.

2. Description of Related Art

There exist in the conventional art a considerable variety of beverage containers, such as water and coffee containers, adapted for users to fill and refill, and to ingest liquid from the container as desired. There exist in the art as well a considerable variety of vapor pens and the like for users to draw flavored vapor and the like as desired. What is needed is a closure for existing beverage containers, the enclosure having apparatus with alternative draw elements, that allows drawing liquid, such as coffee or water from the container by one draw element, and allows drawing from an enclosed vapor-producing apparatus through a separate draw element.

BRIEF SUMMARY OF THE INVENTION

In one embodiment of the invention a dual-access closure for a beverage container is provided, comprising a body having a flexible rim adapted to snap over an upper rim of a beverage container, a sealed, elongated enclosure attached to an underside of the body, a first access element adapted to open and close a first opening passing through the body into the sealed, elongated enclosure, a vapor-producing apparatus within the sealed, elongated enclosure and coupled to the first opening, and a second access element adapted to open and close a second opening passing through the body, outside the sealed, elongated enclosure. With the body engaged to the top of the beverage container, a user is enabled to manipulate the first access interface to draw vapor from the vapor-producing apparatus, and to manipulate the second access element to ingest a beverage from the beverage container.

In one embodiment the dual-access closure further comprises a tubing coupled to the second opening, the tubing extending downward into any beverage contained in the beverage container. Also in one embodiment the closure further comprises a flexible adapter shaped to connect to the first opening at one end, and to any one of a plurality of different vapor-producing apparatus at an opposite end. In one embodiment the beverage container is a paper cup. And in one embodiment the first access element is an elongated element having a first hole through a length of the element, pivoted within a first elongated well on an upper region of the body, in a manner that with the first access element lying in the first well the first opening passing through the body is sealed by a surface of the first access element, and with the first access element rotated to extend upward from the well, the first hole through the length aligns with the first opening such that a passage is created from an upper end of the access element into the sealed, elongated enclosure.

In one embodiment the second access element is an elongated element having a first hole through a length of the element, pivoted within a second elongated well on an upper region of the body, in a manner that with the second access element lying in the second well the second opening passing through the body is sealed by a surface of the second access element, and with the second access element rotated to extend upward from the well, the hole through the length aligns with the second opening such that a passage is created from an upper end of the access element to below the body outside the sealed, elongated enclosure. Also in one embodiment the closure further comprises a first vent hole through the body, opening through a floor of the first elongated well, such that a tip on the first access element closes the vent hole with the first access element lying in the well, and the vent hole is opened with the first access element rotated to extend upward from the first elongated well. Also in one embodiment the closure further comprises a second vent hole through the body, opening through a floor of the second elongated well, such that a tip on the second access element closes the vent hole with the second access element lying in the well, and the vent hole is opened with the second access element rotated to extend upward from the second elongated well.

In one embodiment a dual-access closure for a beverage container is provided, comprising a body having an attachment interface to engage to a top of a beverage container, a sealed, elongated enclosure attached to an underside of the body, a first access element adapted to open and close a first opening passing through the body into the sealed, elongated enclosure, a tubing connected to the first opening and extending downward into the sealed, elongated enclosure, and a second access element being a pivoted lid adapted to close the second opening, and proximity of the second opening to an edge of the body provides for a user tilting the beverage container, and drinking the second beverage directly from the second opening. With the body engaged to the top of the beverage container, the beverage container may hold a first beverage, and the sealed, elongated enclosure may hold a second beverage, and each beverage may be selectively accessed through the associated access element.

In one embodiment the closure further comprises a tubing coupled to the second opening, the tubing extending downward into any beverage contained in the beverage container. In one embodiment the attachment interface of the body is a flexible rim adapted to snap over an upper rim of a beverage container. And in one embodiment the beverage container is a paper cup.

DETAILED DESCRIPTION OF THE INVENTION

Figure 1:
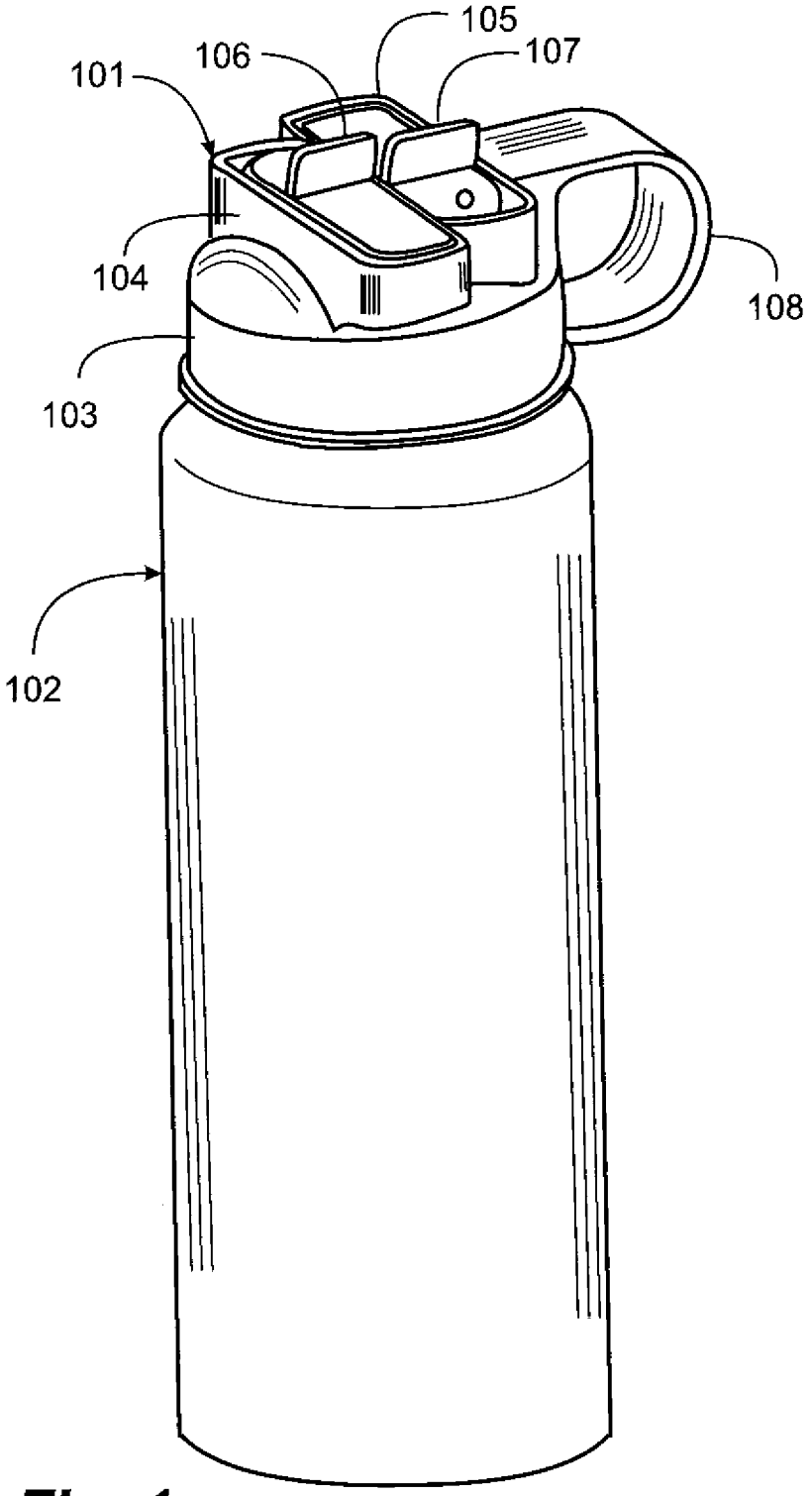
FIG. 1 is an elevation view of a container closure engaged to a container in an embodiment of the invention.

FIG. 1 is an elevation view of a container closure 101 engaged to a container 102 in an embodiment of the invention. The container may be any one of a variety of conventional beverage containers known in the art, such as, for example, an aluminum coffee container like many provided by coffee enterprises. Closure 101 in this embodiment of the invention comprises a body 103, which in this example has an internal female thread to engage a male threaded top of container 102. In alternative embodiment the closure may have a body with a male thread to engage a female threaded top of a container. In other embodiments the closure may have an interface to engage containers of other sorts, such as even paper cups and the like.

In the example shown in FIG. 1 closure 101 has two access wells 104 and 105. Access well 104 has a pivoted access element 106, that tipped up opens a path from a draw tip down through the closure into a second sealed enclosure within the outer enclosure of container 102. In this example a vapor-producing apparatus such as a vape pen is connected within the second sealed enclosure through access element 106, enabling a user to tip up element 106, and to draw vapor from the vapor-producing apparatus.

Access well 105 has a pivoted access element 107, similar in design and function to access element 106, that connects to a tubing under the closure, the tubing extending downward into any liquid, such as water or coffee, that may be carried in container 102. A user may tip up access element 107 and draw liquid through the tube and the access element as one would using a straw. There is a vent hole not shown that serves to equalize pressure. Finally, a handle 108 is provided on the closure to carry the closure and any added container.

Figure 2:
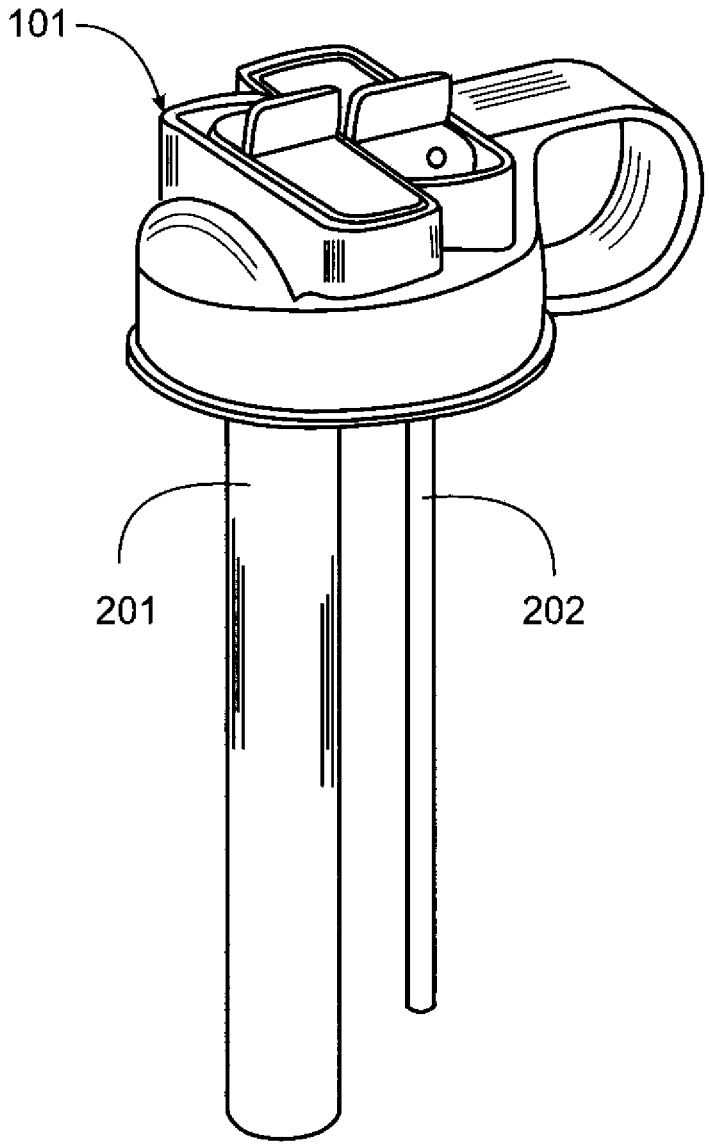
FIG. 2 illustrates the container closure of FIG. 1 removed from the container and showing an inner sealed enclosure.

FIG. 2 illustrates closure 101 removed from container 102, showing the second inner sealed enclosure 201, that may enclose, for example, a vapor-producing apparatus, and also a tubing 202 that extends downward, and may extend into any liquid that may be carried in a container like container 102. It should be noted that enclosure 201 is completely enclosed and sealed from liquid that may be in container 102, while tube 202 is open to the liquid, and extends downward into the liquid, which may be water, coffee or any other beverage. Tube 202 may be fashioned of a suitable polymer material.

Figure 3:
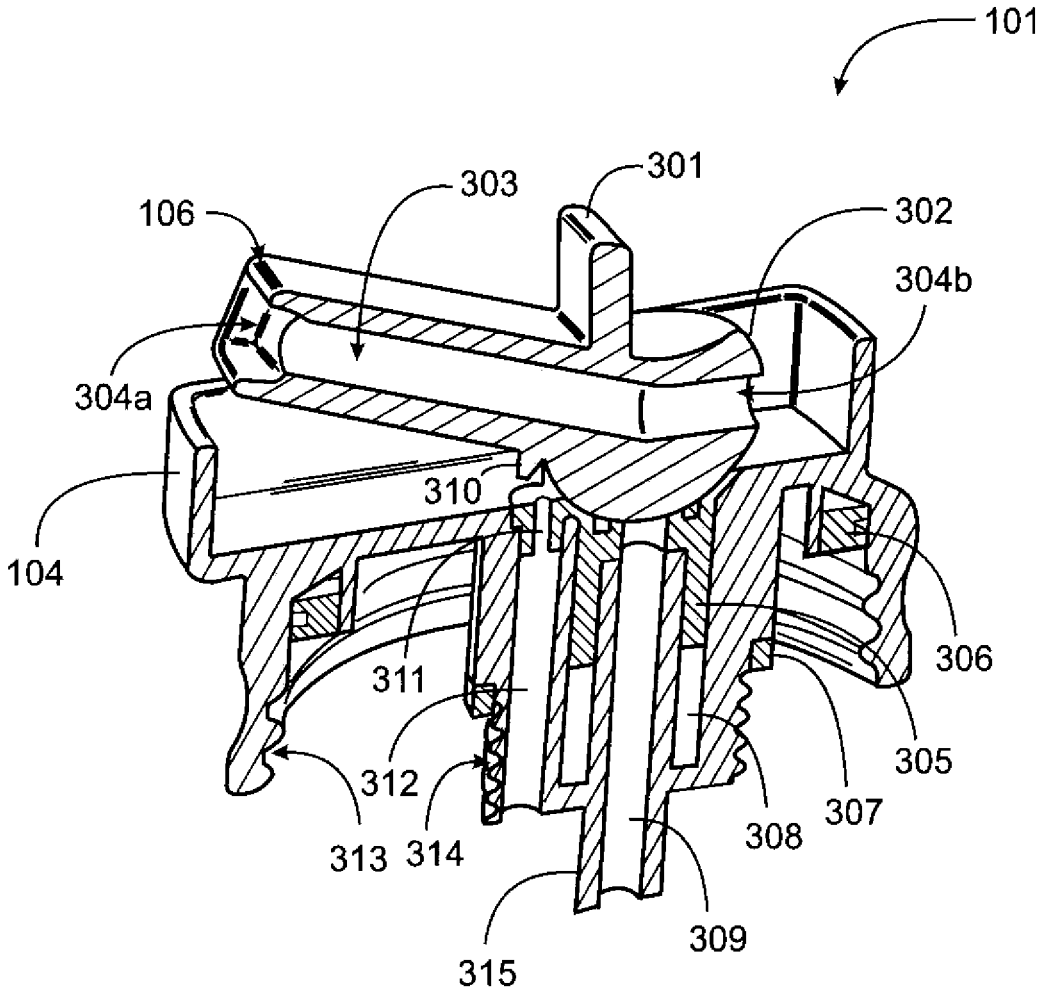
FIG. 3 is a partial section view through the closure of FIG. 1.

FIG. 3 is a partial section view through closure 101, taken along a centerline of well 104 and access element 106. It may be seen in this section that well 104 is a rectangular enclosure with an open top. Access element 106 is an elongated unit of a width to fit into the width of well 104. There is a passage 303 through the length of element 106, with an opening 304*a* on one end and an opening 304*b* on the other. The end of element 106 with opening 304*b* has a spherical shape and opening 304*b* opens through this spherical shape. Access element 106 is pivoted across well 104 along an axis at the center of the spherical shape, such that a user may use tip 301 to rotate the access element around the pivot access to a stop point where opening 304*b* aligns with a vertical passage 309 through closure 101.

A seal element 305 locates in a passage 308 and has a concave spherical shape facing upward into well 104, and the spherical shape 302 of access element 106 rests in and rotates against seal element 305. At the rotation stop point that opening 304*b* aligns with vertical passage 309, a user may place lips on the end of element 106 with opening 304*b*, and may draw on the volume into which vertical passage 308 opens below closure 101.

In addition to access to passage 309 through the passage 303 through access element 106, there is a small vent hole 311 vertically through seal element 305, and this hole communicates with a passage 312 into the volume below closure 101. A small tip 310 on the underside of access element 106 closes hole 311 when the access element is rotated to be fully within well 104. Passage 309 leads to and through a cylindrical nib 315.

A male threaded portion 314 on a lower portion of closure 101 provides for engagement of an elongated enclosure 201 (see FIG. 2) by a female thread on the top of enclosure 201. There is also a gasket 307 against which enclosure 201 seats when fully engaged by threaded portion 314. Internal female threads 313 are to engage with external male threads at the top of beverage container 102, and a gasket 306 engages a top rim of the beverage container to provide a seal.

Figure 4:
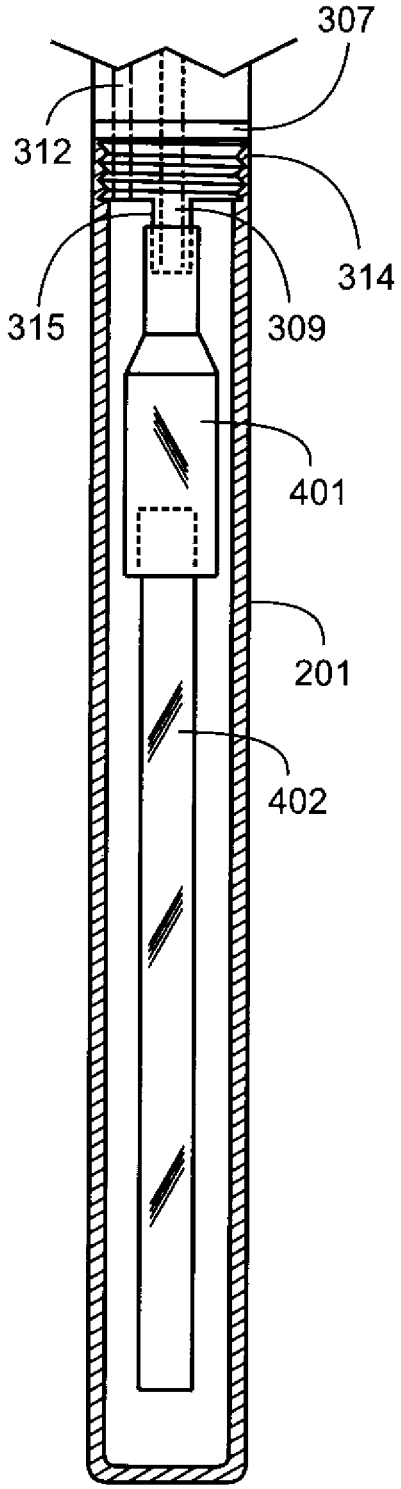
FIG. 4 is an elevation view, in section, of the inner sealed enclosure of FIG. 2.

FIG. 4 is an elevation view, in section, of inner sealed enclosure 201 engaged by internal threads to threads 314 of closure 101. Sealed enclosure 201 fully engaged by threads 314 urges against a gasket 307, also seen in FIG. 3, by which the inner volume of enclosure 201 is isolated from the volume within beverage container 102. In one embodiment of the invention an adapter 401, molder of a flexible polymer, has a circular opening on one end to connect to nib 315, and opening on the opposite end to connect to a vapor-producing apparatus 402, which may be a conventional vape pen of one of several types. When access element 106 is fully rotated to a stop to align opening 304*b* with passage 309 a user may draw on opening 304*a* to ingest vapor from vapor-producing apparatus 402. Passage 312 provides a vent to atmosphere for the volume in enclosure 201 outside the vapor-producing apparatus.

Figure 5:
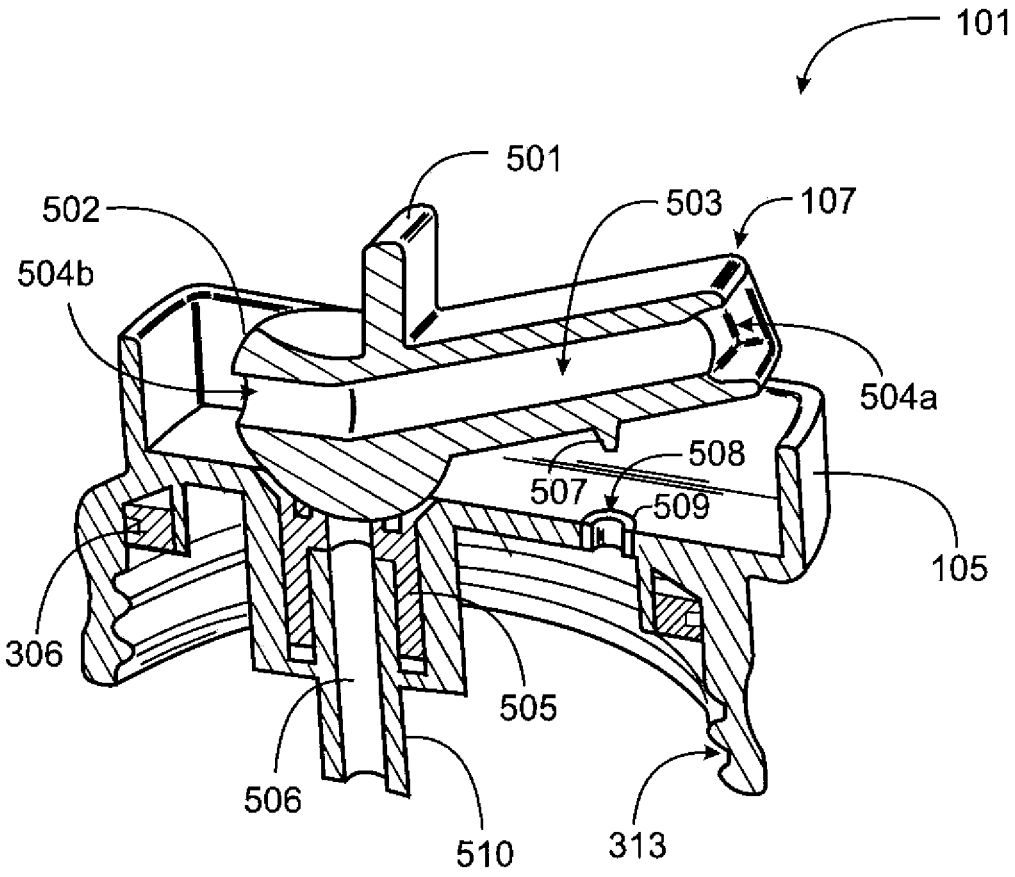
FIG. 5 is a section through the container closure of FIG. 1.

FIG. 5 is a section through closure 101 along a centerline of access element 107 in well 105. Access element 107 differs from access element 106 by the placement of a tip 507 in a position to close a vent opening 508 through a bottom surface of well 105 into the inner volume of beverage container 102. Vent opening 508 has a seal element 509 to secure a good seal when access element 107 is rotated down to close opening 508 by tip 507.

A seal element 505 similar to seal element 307 of FIG. 3 surrounds an opening to passage 506 in a bottom surface of well 105. Access element 107 has a spherically-shaped end 502 the matches a spherical shape of seal element 505 such that access element 107 may be rotated by tip 501 to align opening 504*b* with passage 506. Passage 506 terminates at a nib 510 to which tubing 202 connects, by virtue of tubing 202 being formed of a flexible polymer material. In an alternative embodiment tubing 202 may connect to nib 510 by a flexible tubing adapter piece. With access element 107 fully rotated to a stop and opening 504*b* aligned with passage 506 a user may draw on opening 504*a* to bring liquid up from beverage container 102, through passage 506 and passage 503, into the user's mouth.

It will be apparent to the skilled person that the closure 101 as described above, in concert with inner enclosure 201, adapter 401 and vapor apparatus 402, and tubing 202 may selectively open and close the two separate access elements and access either vapor from vapor apparatus 402 or sips of beverage from beverage container 102.

Figure 6:
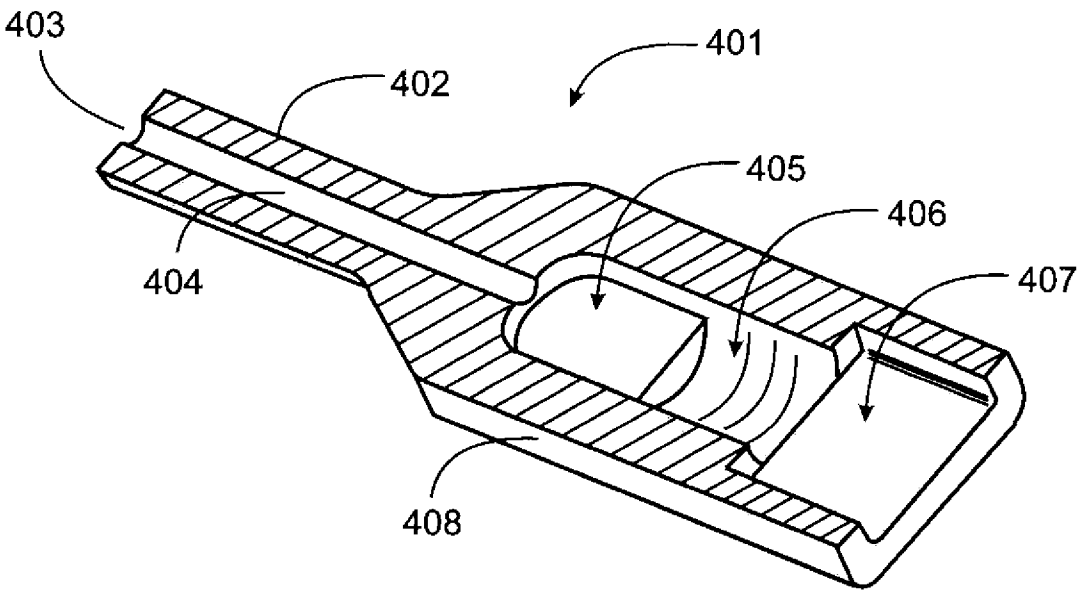
FIG. 6 is a partially sectioned view of an adapter shown in FIG. 4.

FIG. 6 is a partially sectioned view of adapter 401 of FIG. 4, adapted to connect nib 315 and vapor apparatus 402.

Region 402 is circular with circular internal passage 404, which is pushed onto nib 315 to connect to passage 309. A wider portion 408 has differently shaped internal regions 405, 406 and 407 to engage tip ends of different vapor-producing apparatus. In the example illustrated by FIG. 4 the engagement is by region 407, as the vapor-producing apparatus of FIG. 4 has a wider and flat aspect. In one embodiment adapter 401 is molded to accommodate and connect to three of the more preferred conventional vapor-producing apparatus.

In the figures and description above closure 101 is illustrated and described as having internal threads to match external threads on an upper extremity of a beverage container. In an alternative embodiment the beverage container may have an internal threaded upper region, and closure may have an externally threaded region to engage the internal threads of the beverage container. In yet another embodiment the closure may be adapted to snap fit on the upper rim of a beverage container having a plain upper rim, like, for example a paper cup.

Figure 7:
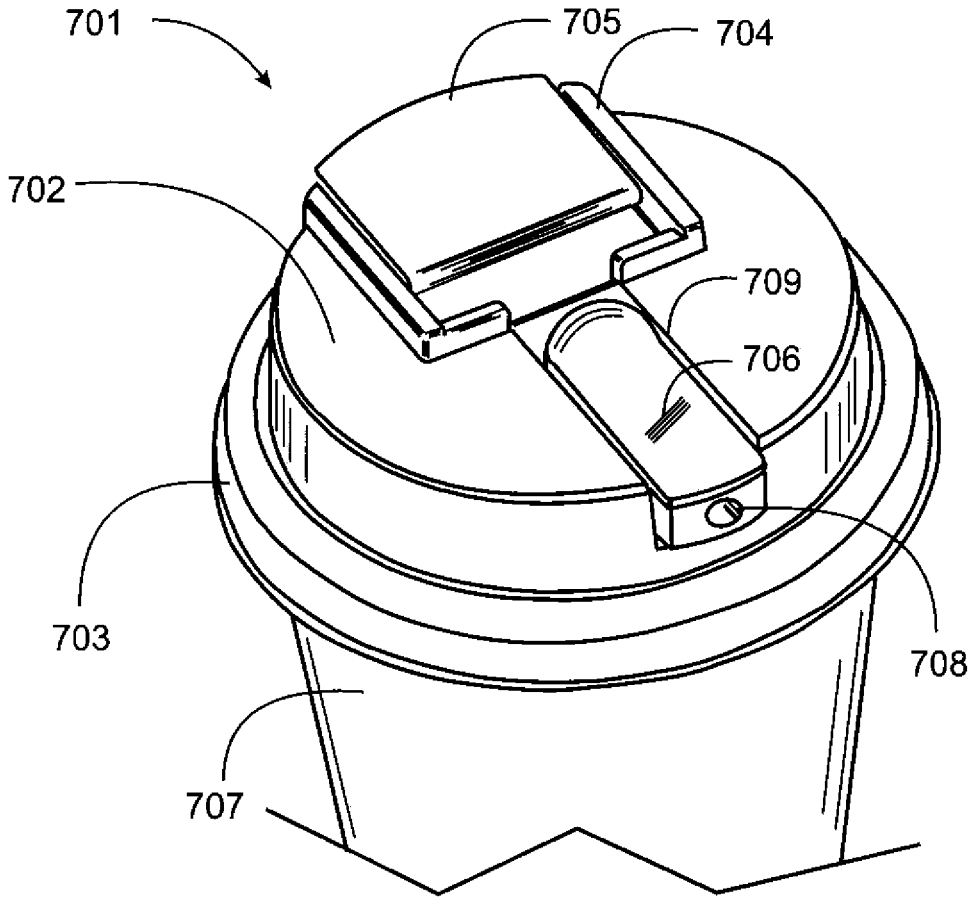
FIG. 7 is a perspective view of a closure for a container in an alternative embodiment of the invention.

FIG. 7 is a perspective view of a closure 701 adapted to snap onto a thin-walled beverage container 707, such as a paper cup, for example. In this example the closure has an upper body 702 that is molded of a polymer material, and is substantially rigid. A lower body 703 has a relatively thin wall to allow the lower body some flexibility to engage an upper rim of the beverage container 707. A substantially rectangular well 704 is formed in the upper body, and a pivoted cover 705 engages inner walls of the well. A second well 709 is formed in the upper body and an access element 706 engages inner walls of well 709. Access element 706 is similar to access elements 106 and 107 of FIG. 2, and has an opening 708 to a channel through the length of the access element.

Figure 8:
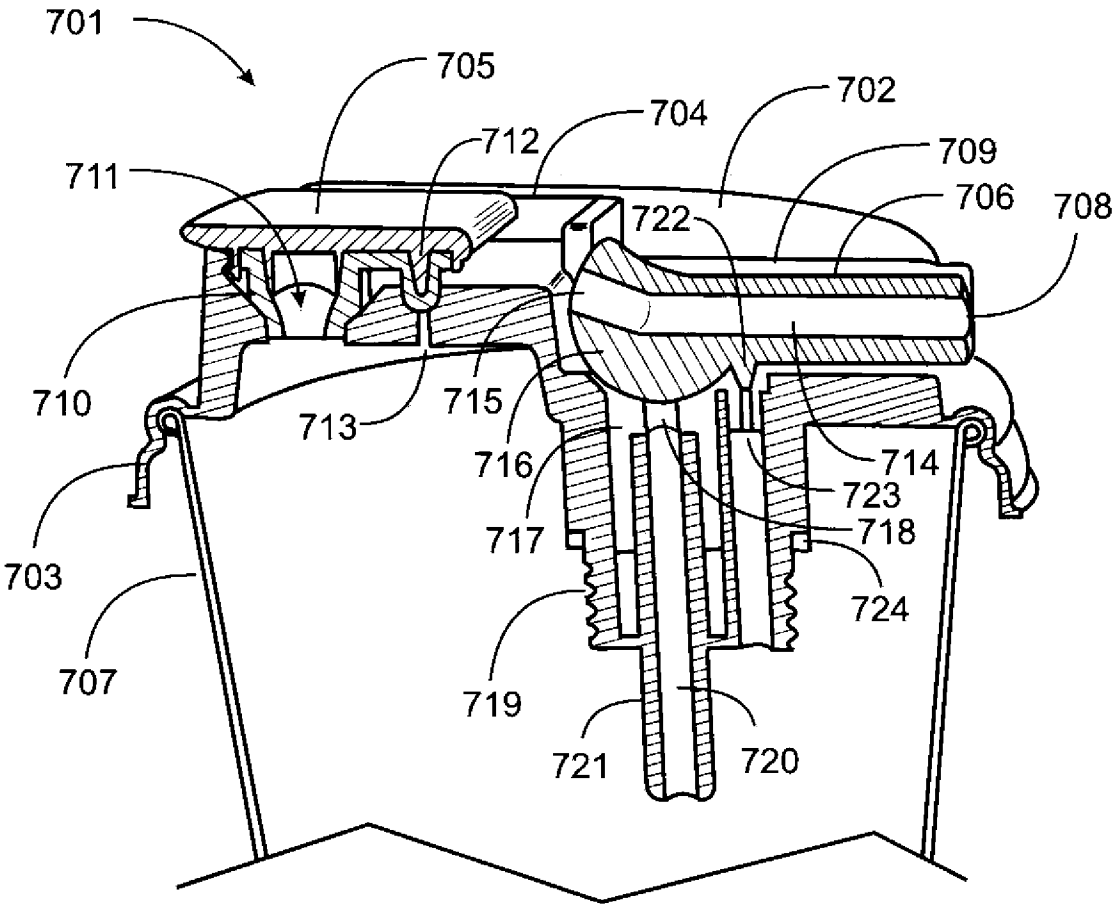
FIG. 8 is a cross section of the closure of FIG. 7.

FIG. 8 is a cross section of closure 701 taken along a centerline that passes lengthwise through both pivoted cover 705 and access element 706. The thin-wall lower body 703 is illustrated as snapping over an upper rim of paper cup 707. In this embodiment there is a gasket seat 710 in a vertical opening through closure body 702 that presents an opening 711 that is closed by a shape of pivoted cover 705 with the pivoted cover in a downward horizontal closed position. When pivoted cover 705 is pivoted upward opening 711 is exposed, and provides an interface for a user to place the lips at the edge of the closure, tilt the beverage container and drink from the container just as a user would an open container. Opening the pivoted cover also opens a vent hole 713 that is closed by tip 712 with the pivoted cover in the closed position.

Access element 706 is pivoted within well 709 just as access elements 106 and 107 in wells 104 and 105, and access element 706 has a spherically-shaped end 716 that mates with a spherical shape of a gasket seat 717, such that access element 706 may be rotated to align opening 715 with opening 718, such that channel 720 is open through opening 718, opening 715, channel 714 and opening 708 to the outside. In this example male threads 719 are the same as threads 314 shown in FIG. 3, such that an inner enclosure 201 may be engaged by female threads to male threads 719 just as illustrated in FIG. 4, to bear on a gasket 724. Adapter 401 of FIG. 4 may be engaged to nib 721 and to a vapor-producing apparatus 402, just as illustrated in FIG. 4.

Closure 701 is thus a dual-access container closure just as is closure 101. A user may manipulate pivoted cover 705 to drink from the paper cup, and may manipulate access element 706 to draw vapor from a vapor-producing apparatus such as apparatus 402 and others, adapted to the closure by an adapter such as that illustrated in FIG. 6.

A skilled person will understand that the embodiments illustrated in FIGS. 2 and 3 may be adapted to snap onto a paper cup, such as beverage container 707 of FIGS. 7 and 8, as shown in FIG. 8, and also that the embodiment shown in FIG. 8 might also be adapted to have a male or a female thread to engage threads of a beverage container, as described above for the embodiment illustrated by FIGS. 2 and 3.

In yet another embodiment of the invention, referring again to FIG. 2 and to FIG. 4, the adapter 401 and the vapor-producing apparatus may be removed from inside the sealed enclosure 201, and a tubing similar to tubing 202 may by connected to nib 315 to extend down into the interior of the sealed enclosure. In this arrangement one beverage may be introduced into container 102 outside the sealed enclosure 201, and a second, different beverage may be introduced into sealed enclosure 201. In this arrangement the two beverages are completely separated, and do not mix, and a user may draw one beverage from the container outside the sealed enclosure, and a different beverage from inside the sealed enclosure within he beverage container. As a simple example, one may have water in one place and vodka in another, and may manipulate the access elements to imbibe one or the other.

A skilled person will also understand that the embodiments and example presented and described above are all exemplary, and not limiting to the invention. Embodiments of the invention may incorporate features described an several variations. The scope of the invention is limited only by the claims.

The invention claimed is:

1. A dual-access closure for a beverage container, comprising:

a circular body having a rigid upper portion and a descending flexible rim around a periphery of the rigid upper portion, the flexible rim adapted to snap over an upper rim of a beverage container;

a first rectangular well in the rigid upper portion, having a first length, a first width, and a lengthwise centerline, the first rectangular well positioned entirely in a first semi-circular area being a first half of the the rigid upper portion;

a first opening through a bottom wall of the first rectangular well, the first opening proximate the periphery of the rigid upper portion;

a rectangular cover pivoted within the first rectangular well, the rectangular cover having a shape on an underside to plug the first opening with the rectangular cover closed;

a second rectangular well having a second length and a second width, less than the first width, centered on the lengthwise centerline, positioned entirely in a second semi-circular area being a second half of the the rigid upper portion, the second rectangular well having a second opening through the rigid upper portion in a concave curved surface in the bottom of the second rectangular well, the opening connecting to an inner volume of a sealed, elongated enclosure joined by a threaded connection to a bottom surface of the rigid upper portion of the circular body;

an elongated access element with a central bore opening at one end through a convex curved surface and at an opposite end, the elongated access element pivoted in the second rectangular well in a manner that the convex curved surface rotates in the concave curved surface, and with the elongated access element rotated down completely into the second rectangular well the openings are not aligned, and with the access element rotated with the openings aligned the access element extends upward from the second rectangular well;

wherein, with the circular body engaged to the top of the beverage container, a user is enabled to pivot open the rectangular cover and imbibe a first beverage directly from the inside of the container, and the user is enabled to pivot open the elongated access element to extend upward from the second rectangular well, connecting the opening at the upper end of the access element to the inner volume of the sealed, elongated enclosure.

2. The dual-access closure of claim 1 further comprising a tubing coupled to the second opening, the tubing extending downward into a beverage contained in the the inner volume of the sealed, elongated enclosure, enabling the user to pivot the elongated access element upward and to imbibe the second beverage from the sealed, elongated enclosure.

3. The dual-access closure of claim 1 wherein the beverage container is a paper cup.

4. The dual-access closure of claim 1 further comprising a first vent hole through the rigid upper portion, opening through the bottom wall of the first rectangular well, and further comprising a tip on an underside of the rectangular cover positioned to seal the first vent hole with the rectangular cover closed.

5. The dual-access closure of claim 4 further comprising a second vent hole through the rigid upper portion, opening through a bottom wall of the second rectangular well, such that a tip on the elongated access element closes the second vent hole with the elongated access element closed.

6. The dual access closure of claim 1 further comprising a short tubing coupled to the second opening, a flexible adapter coupled at one end to the short tubing, and at an opposite end to a vapor-producing apparatus containe entirely within the inner volume of the sealed, elongated enclosure, such that a user is enabled to open the elongated access elemt and to ingest vapor from the vapor-producing apparatus, and the user is enabled to remove the circular body from the beverage container, remove the sealed, elongated enclosure from the bottom of the circular body, and to exchange the vapor-producing apparatus for a different vapor-producing apparatus.

* * * * *